US010919303B2

(12) United States Patent
Hitzlsperger

(10) Patent No.: US 10,919,303 B2
(45) Date of Patent: Feb. 16, 2021

(54) DEVICE AND METHOD FOR SUPPLYING A PRINT HEAD WITH INK IN AN INK PRINTING APPARATUS

(71) Applicant: Canon Production Printing Holding B.V., Venlo (NL)

(72) Inventor: Florian Hitzlsperger, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/775,792

(22) Filed: Jan. 29, 2020

(65) Prior Publication Data

US 2020/0238714 A1 Jul. 30, 2020

(30) Foreign Application Priority Data

Jan. 29, 2019 (DE) ..... 10 2019 102 101

(51) Int. Cl.
*B41J 2/175* (2006.01)

(52) U.S. Cl.
CPC ..... *B41J 2/17506* (2013.01)

(58) Field of Classification Search
CPC ..... B41J 2/17506; B41J 2/18; B41J 2/175
See application file for complete search history.

(56) References Cited

U.S. PATENT DOCUMENTS 9,248,667 B2 2/2016 Biglari
2012/0001988 A1* 1/2012 Izawa ..... B41J 2/175 347/85
2016/0052259 A1 2/2016 Sugitani et al.
2016/0075144 A1 3/2016 Sugitani et al.
2016/0089896 A1* 3/2016 Nishiyama ..... B41J 2/17566 347/6

FOREIGN PATENT DOCUMENTS

DE 10 2013 110 799 A1 4/2015

OTHER PUBLICATIONS

German Office Action dated Sep. 17, 2019, for Application No. 10 2019 102 101.4.

* cited by examiner

*Primary Examiner* — Sharon Polk
(74) *Attorney, Agent, or Firm* — Schiff Hardin LLP

(57) ABSTRACT

A device for supplying a print bar (10) with ink has a distributor tank (16) that is connected with all print heads (12). Degassed and tempered ink is supplied to the distributor tank (16). In the distributor tank (16), a ring line (36) extends through which flows ink at the nominal temperature, and the ink (19) in the distributor tank (16) is thereby tempered. In addition to this, the distributor tank (16) has a supply line (38) via which fresh ink may be fed into the distributor tank (16). A changeover switch (42) switches between the two lines depending on the negative pressure in the distributor tank (16).

10 Claims, 3 Drawing Sheets

DEVICE AND METHOD FOR SUPPLYING A PRINT HEAD WITH INK IN AN INK PRINTING APPARATUS

CROSS REFERENCE TO RELATED APPLICATIONS

This patent application claims priority to German Patent Application No. 102019102101.4, filed Jan. 29, 2019, which is incorporated herein by reference in its entirety.

BACKGROUND

Field

The disclosure relates to a device and method for supplying at least one print head with ink in an ink printing apparatus.

Related Art

Ink printing apparatuses may be used for single-color or multicolor printing to a printing substrate, for example a single sheet or a recording medium of the most varied materials, for example paper, said recording medium being in the form of a web. The design of such ink printing apparatuses is known. In these, ink droplets are ejected from corresponding nozzles of a print head in order to print a print image onto the recording medium.

The generation of the ink droplets then leads to a qualitatively good print image if the print heads of the print bar are supplied with tempered and degassed ink. For this, given a known device (DE 10 2013 110 799 A1) a distributor tank is provided that supplies the print heads with ink via a counter-pressure tank, a tubular heater, and a distributor tank. The ink thereby arrives degassed from the counter-pressure tank and is heated to a desired nominal temperature by the tubular heater.

If, given this known device, printing does not occur or only seldom occurs, the ink in the distributor tank cools off, since in this state less ink is drawn from the distributor tank, and therefore less fresh, tempered ink is also supplied. If more ink is then required again for the print heads, it inevitably takes some time until the ink in the distributor tank arrives at the desired temperature. The print quality is worse as a result of the not-yet-reached nominal temperature.

It may also occur that the control electronics for the print heads, which generate heat during operation, heat the ink the directly adjoining distributor tank, such that the ink temperature in said distributor tank is above the nominal temperature. In this instance as well, the print image quality is degraded until the desired nominal temperature prevails again the distributor tank. However, this only occurs bit by bit with the refilling of ink heated to the nominal temperature.

If the distributor tank has a separating heater, this is on the one hand very costly in terms of power, and on the other hand ink constituents may deposit locally over time, or the chemical composition may change.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 2:
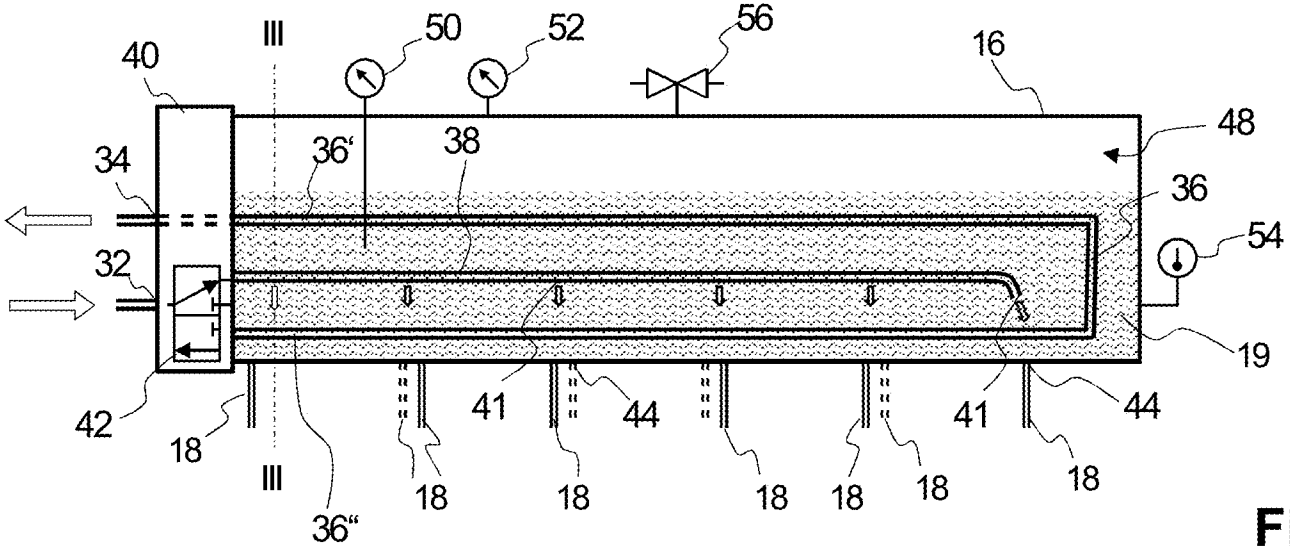
FIG. 2 is a longitudinal sectional view through a distributor tank according to FIG. 1.
Figure 3B:
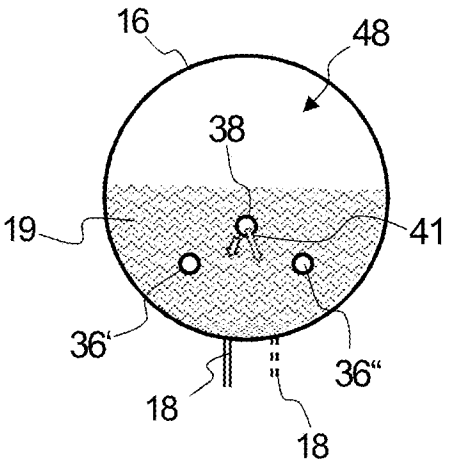
Figure 3A:
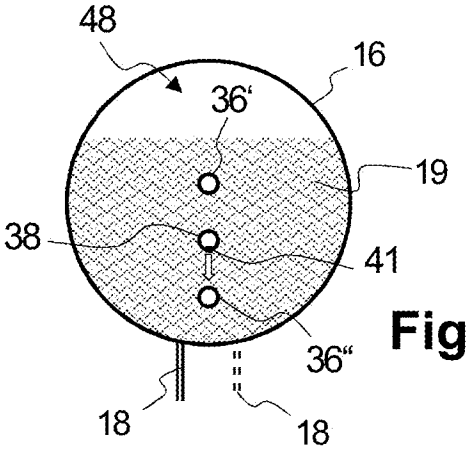

FIG. 3*a* is cross-sectional view through of the distributor tank according to FIG. 2, FIG. 3*b* is a cross-sectional view of a distributor tank according to an exemplary embodiment.

Figure 4:
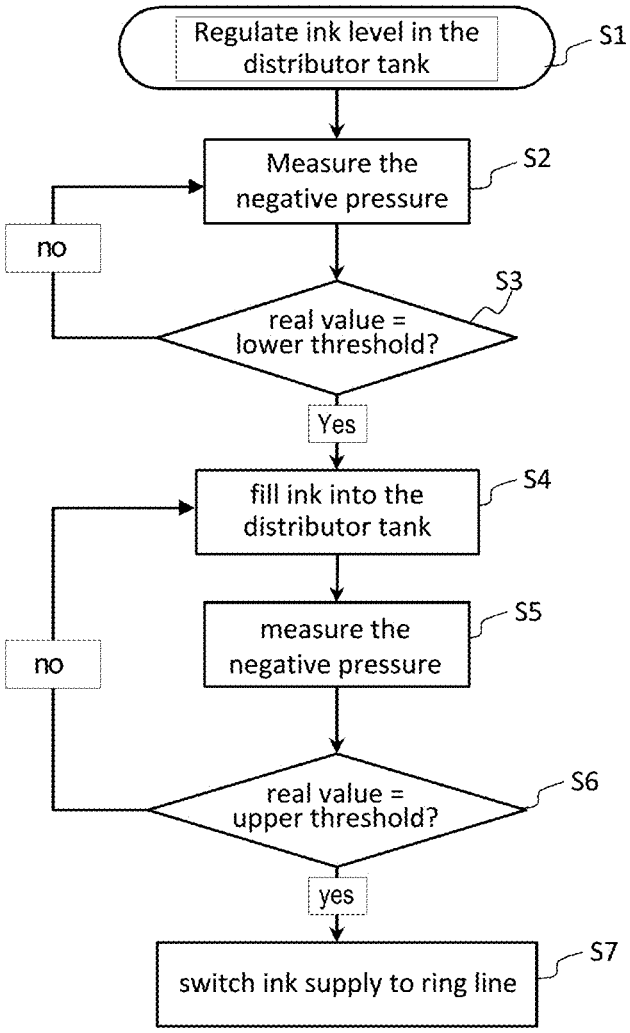

FIG. 4 is a flowchart of a method for supplying a print head with ink in an ink printing apparatus according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a device and a method for supplying a print head with ink in an ink printing apparatus in which the ink supplied to the print head largely is at a nominal temperature.

The device thereby has a distributor tank to which degassed and heated ink is supplied from a storage reservoir. The ink from the distributor tank is provided to the print head for printing. In an exemplary embodiment, the distributor tank has a ring line (e.g. closed circular pipeline, or loop) and a supply line, between which is arranged a changeover switch that selectively connects the ink supplied from the storage reservoir to one of the two lines. If the ink is switched to the ring line, the ink flows through the ring line. For this purpose, the ink circulates from the storage reservoir, across the heater, through the ring line, back to the storage reservoir. The ring line with the tempered ink is thereby in good thermal contact with the ink in the distributor tank, whereby this is tempered. If the ink supply is switched to the supply line, fresh ink is refilled into the distributor tank until a predetermined fill level or negative pressure is achieved there and the consumed ink is compensated for.

The ink circulation through the ring line has the advantage that the ink in the distributor tank is continuously tempered by the flowing ink heated to the nominal temperature. If the ink in the distributor tank is too cool, it is heated. If it is too warm, it is cooled by the flowing ink.

In an exemplary embodiment, for the supply of the print heads with ink, the distributor tank advantageously extends over the entire region near which print heads are arranged such that the path of the ink to the print heads is of optimally equal length for all print heads and is optimally short. Only a very slight temperature drop thus takes place on the way to said print heads.

In an exemplary embodiment, in order to heat ink particularly efficiently, the ring line and the supply line are entirely surrounded by ink in the distributor tank. It is advantageous if the distributor tank is not entirely filled with ink. An air volume is then still present that serves as a damper given dynamic pressures, in order to damp pressure fluctuations of the hydraulic pressure of the ink in the distributor tank.

In the following, the device for supplying a print head 12 (FIG. 1) with ink in an ink printing apparatus is, for the sake of simplicity, explained using a single print bar 10 that includes three print heads 12. With the print heads 12, ink droplets are printed line by line onto a recording medium 14 (in FIG. 1, the recording medium 14 moves into or out of the plane of the image).

All print heads 12 of a print bar 10 print a respective different color (e.g. YMCK), and each print bar 10 has its own ink supply. In order to supply ink to the print heads 12 with their nozzles, a distributor tank 16 is provided that extends across all print heads 12 of a print bar 10 and has corresponding feed lines 18 to the print heads 12.

Figure 1:
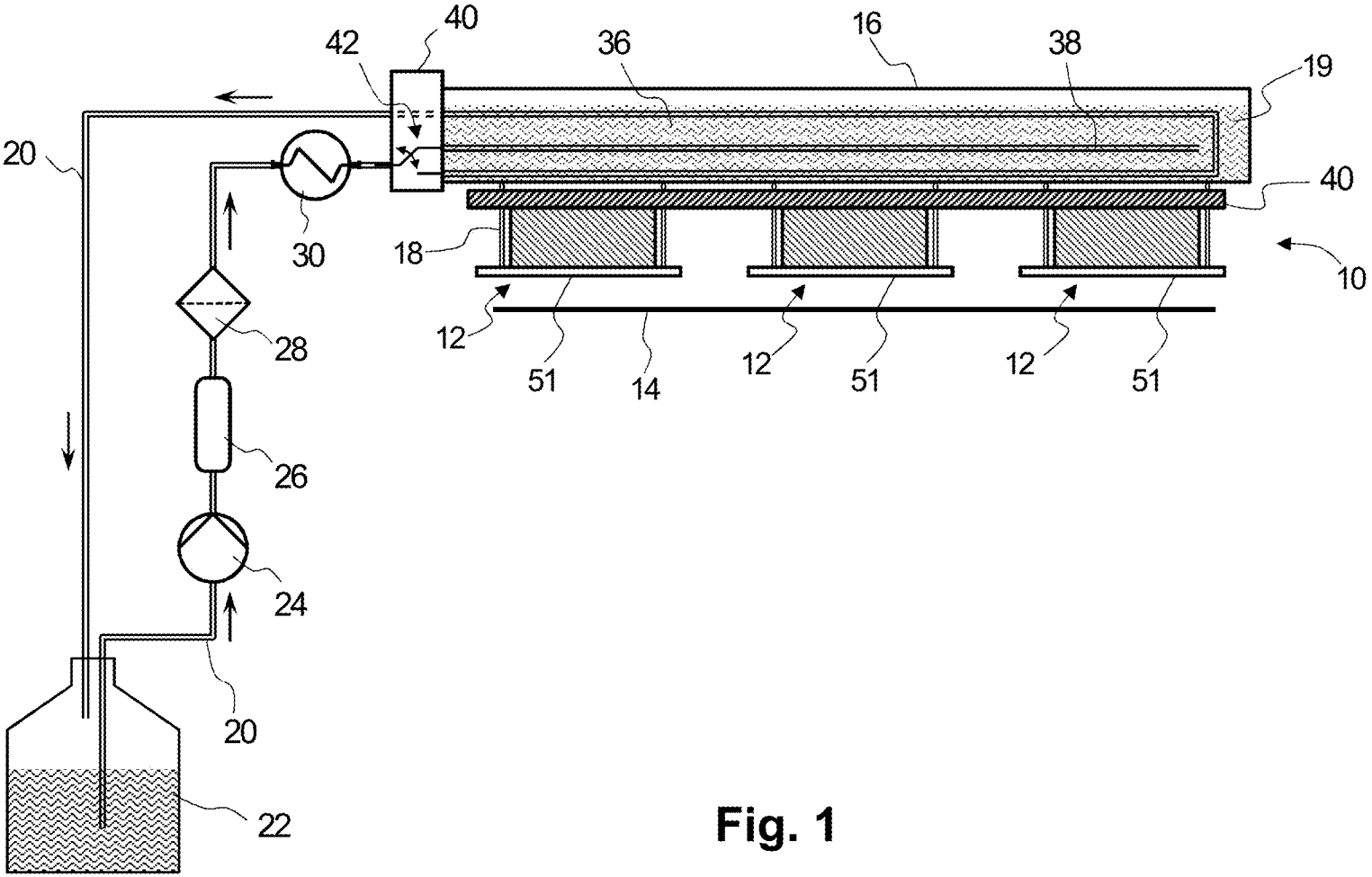
FIG. 1 illustrates a device configured to supply a print head with ink according to an exemplary embodiment.

In an exemplary embodiment, ink 19 is supplied to the distributor tank 16 via an ink line 20 from a storage reservoir 22 (see arrows in FIG. 1 for the flow direction of the ink). In an exemplary embodiment, a conveyor pump 24, an optional degassing device 26, an optional particle filter 28, and a heater 30 are arranged between the storage reservoir 22 and the distributor tank 16. Degassed, cleaned, and tempered ink 19 may thus be supplied to the distributor tank 16.

In an exemplary embodiment, the distributor tank 16 has an inflow 32 (see FIG. 2) and an outflow 34. Ink 19 is conveyed into the distributor tank 16 via the inflow 32, and ink from the distributor tank 16 arrives back at the storage reservoir 22 via the outflow 34.

In an exemplary embodiment, in the distributor tank 16, two conduit systems that are separate from one another are arranged, and in fact a ring line 36 and a supply line 38. The ink from the storage reservoir 22 may be switched to one of the two lines 36, 38 via the inflow 32. If the inflow 32 is connected with the ring line 36, the supplied and heated ink flows through the ring line 36 and, via the outflow 34, flows back to the storage reservoir 22. If the inflow 32 is connected with the supply line 38, fresh ink 19 flows into the distributor tank 16 via the supply line 38 in order to fill up consumed ink again.

The distributor tank 16 is sealed tight with a sealing element 40 so that no ink 19 may escape from the distributor tank 16—except for at existing ink outlets 44 via the feed lines 18 to the print heads 12. A hydraulic changeover switch 42 that may switch the ink flow between ring line 36 and supply line 38 is arranged in the sealing element 40.

In an exemplary embodiment, the ring line 36 extends from an exit of the changeover switch 42, through the distributor tank 16, to the outflow 34. The ring line 36 has no outlet for ink 19, such that it may only flow through the ring line 36. The ring line 36 is directed on an optimally long path through the distributor tank 16 so that the ink flowing through the ring line 36 has thermal contact with the wall of said ring line 36 that is efficient and over an optimally large area, and therefore a good, effective thermal transfer exists between flowing ink in the ring line 36 and the ink 19 in the distributor tank 16.

The supply line 38 extends from another exit of the changeover switch 42 into the distributor tank 16. It has at least one opening 41 (see arrows at the supply line in FIG. 2) inside the distributor tank 16 from which fresh ink may flow into the distributor tank 16.

The distributor tank 16 has a plurality of outlets 44 that are respectively connected with a feed line 18, that are in turn connected with a print head 12 and supply ink from the distributor tank 16 to said print head 12 (in FIGS. 1 and 2, two feed lines 18 are depicted per print head 12).

In an exemplary embodiment, if ink brought to the nominal temperature flows through the ring line 36, the ink 19 in the distributor tank 16 is tempered. So that the temperature distribution of the ink 19 in the distributor tank 16 is optimally uniform/homogeneous, at least in the region of the outlets 44 to the print heads 12, the ring line 36 travels closely past this region, thus extends close to all feed lines 18 to the print heads 12, and therefore into the region of all print heads 12.

In an exemplary embodiment, each print head 12 has activation electronics 46 via which the ejection of ink droplets from the nozzles of the print heads 12 is controlled. Located therein are components (such as power components) that generate and emit heat in operation. Since the print heads 12 are arranged near to the distributor tank 16, the danger exists that the ink 19 in the distributor tank 16 is heated by the activation electronics 46. The ink flowing through the ring line 36 automatically tempers the ink 19 in the distributor tank 16, meaning that if the temperature of the ink 19 in the distributor tank 16 is too high, the ink 19 is cooled by the ink circulating through the ring line 36. If the heated ink flows into the distributor tank 16 via the supply line 38, this heats the ink 19 located in the distributor tank 16 via direct contact and mixing. In an exemplary embodiment, two or more print heads 12 can share a common activation electronics.

In an exemplary embodiment, the activation electronics 46 includes processor circuitry that is configured to perform one or more functions and/or operations of the activation electronics, including controlling the actuators of the individual nozzles 21, 22, controlling the overall operation of the printer, and/or controlling the operation of one or more components of the printer. In an exemplary embodiment, the activation electronics 46 is a controller.

The functionality of the device according to exemplary embodiments is explained in detail using FIG. 2. For better understanding, in FIG. 2 the distributor tank is shown overdimensioned. In print operation, the distributor tank 16 is already filled with ink 19 such that the ring line 36 and the supply line 38 are preferably entirely surrounded with ink 19. The initial filling or emptying of the distributor tank 16 is explained further below.

In an exemplary embodiment, the distributor tank 16 is advantageously filled with ink 19 only so far that the ink level is located with certainty above the ring line 36, and advantageously also above the supply line 38. An optimally effective thermal transfer may thus occur between the ink in the ring line 36 and the ink 19 in the distributor tank 16. Since the distributor tank 16 is not entirely filled with ink 19, an air volume 48 which serves for damping purposes remains above the ink 19 (more detailed explanations in this regard are further below).

In print operation, more or less ink is continuously consumed depending on the print utilization, which ink is supplied to the print heads 12 from the distributor tank 16 via the feed lines 18. The ink level in the distributor tank 16 thereby continuously falls. A hydrostatic pressure (here a negative pressure) results via the ink level, which hydrostatic pressure is necessary for a trouble-free print operation and may not be too low. Therefore, the ink level may only fluctuate within a predetermined tolerance range. Before the ink level falls below the lower threshold of the tolerance range (meaning before the ink drops below a predetermined level state), fresh ink corresponding to the consumed quantity of ink must be supplied to the distributor tank 16 via the supply line 38. In addition to this, the ink level may not drop so far that at least the ring line 36 is no longer surrounded by ink 19. The thermal transfer would thereby be starkly restricted.

In an exemplary embodiment, to fill ink, the changeover switch 42 switches the inflow 32 to the supply line 38 so that degassed and tempered ink is supplied to the distributor tank 16 via said supply line 38 until the ink level has reached an upper threshold of the tolerance range. After refilling fresh ink, the supply line 38 has at least one opening 41 from which the ink arrives in the distributor tank 16.

In an exemplary embodiment, additionally or alternatively, holes (i.e. openings 41) are arranged distributed over the length of the supply line 38, from which holes the fresh ink flows (represented by the arrows in FIG. 2). The holes may be designed like nozzles, with a respective defined outflow direction, so that the fresh ink mixes better with the ink 19 located in the distributor tank 16. Due to the mixing, on average a high degree of degassing of the ink 19 also remains well distributed in the distributor tank 16. It is thus ensured that all print heads 12 receive optimally fresh, degassed, supplied ink that is heated to a nominal temperature.

In an exemplary embodiment, a sensor, such as a fill level sensor 50 or a pressure sensor 52, is provided. The sensor can be configured to regulate and/or control the ink level or the required negative pressure. The fill level may be determined directly or also indirectly via the hydraulic pressure prevailing in the distributor tank 16. The fill level is equivalent to the hydraulic pressure that prevails in the distributor tank 16.

If little printing takes place (low ink consumption), or if no printing at all takes place for a brief period of time, the ink 19 in the distributor tank 16 may cool off. In order to bring the ink 19 to the nominal temperature again, heated ink does not need to be refilled; rather, the changeover switch 42 switches the inflow 32 to the ring line 36. Ink that has been brought to the nominal temperature thereby flows continuously through the ring line 36, back to the storage reservoir 22. Heat may thereby be emitted via the wall of the ring line 36 to the ink 19 in the distributor tank 16, or may also be absorbed therefrom.

In an exemplary embodiment, the temperature of the ink 19 in the distributor tank may be measured by a temperature sensor 54. If the measured real temperature of the ink 19 in the distributor tank 16 has fallen below a threshold, the circulation of the heated ink through the ring line 36 is activated. In an exemplary embodiment, this occurs before a restart of the ink printing apparatus, or before longer printing pauses.

If the wall of the ring line 36 conducts heat well, a good thermal transfer occurs. In addition to this, a relatively large surface of the ring line 36 is very beneficial to an effective thermal transfer. In the event that the ink 19 in the distributor tank 16 should be heated above the nominal temperature during a print stoppage, for example by the activation electronics 46 of the print heads 12, the ink flowing through the ring line 36 cools the ink 19 in the distributor tank 16. Otherwise, given continuously flowing ink in the ring line 36, the temperature of the ink 19 in the distributor tank 16 approaches the nominal temperature over time.

In an exemplary embodiment, it is thus advantageous to produce the material of the wall of the ring line 36 from a material with good thermal conductivity (for example copper, aluminum, stainless steel, glass, plastic). The wall may alternatively or additionally be formed quite thin so that the thermal transfer takes place more quickly. The heat of the ink in the ring line 36 then transfers more quickly to the ink 19 in the distributor tank 16, and vice versa. The ink 19 in the distributor tank 16 may thus be tempered, thus be heated or cooled. For a better thermal transfer, the ink may flow more quickly through the ring line 36.

In FIGS. 3*a* and 3*b*, a section transversally through the distributor tank 16 is respectively depicted for two different exemplary embodiments. In FIG. 3*a*, the cross section III-III according to FIG. 2 is depicted. The supply line 38 is thereby located between the two line branches 36', 36" of the ring line 36. A sufficient amount of ink 19 is located in the distributor tank 16 (ink level above the upper ring line branch 36') so that all lines are with certainty surrounded by ink 19, even if the ink level fluctuates due to its function, since in print operation ink 19 is continuously extracted for printing, but ink is only resupplied given a danger of exceeding the lower level threshold. In an exemplary embodiment, it is advantageous if the tolerance range of the ink level does not encompass the ring line 36 or the supply line 38. That is, the ink level is always situated above the lines 36, 38 even given normal fluctuations. A large ink volume and a relatively small air volume 48 thus result.

A further exemplary embodiment of the ring line 36 and the supply line 38 is depicted in FIG. 3*b*. The ring line 36 extends in a horizontal plane, preferably directly over all ink outlets 44 to the feed lines 18 to the print heads 12. The supply line 38 is arranged approximately centrally above the two ring line branches 36', 36", which are located at approximately the same height. Here as well, the ink 19 in the distributor tank 16 constantly surrounds the two lines. In comparison to the embodiment according to FIG. 3*a*, the ink volume is markedly smaller and the air volume 48 is significantly larger. This has the advantage that the smaller quantity of ink 19 may be tempered more quickly, and the larger air volume 48 may better damp hydraulic pressure fluctuations due to the dynamic ink movements as a result of the ejection of ink droplets.

In an exemplary embodiment, the lines 36, 38 do not need to be arranged symmetrical to one another. A suitable asymmetry may even improve the mixing of the ink 19 in the distributor tank 16.

The embodiments of the ring line 36 and the supply line 38 are not limited to the embodiment of FIGS. 3*a* and 3*b*. The longer the path of the ink through the ring line 36, and/or the greater the thermally active outer surface of the ring line 36 in the distributor tank 16, the more effective the thermal transfer. The simplest embodiment of the ring line 36 is u-shaped, and extends in the region above all print heads 12 (in particular the feed lines 18 to the print heads 12) such that optimally identical conditions with an ink temperature near the nominal temperature may be achieved in the region of all ink outlets 44.

In an exemplary embodiment, at least the ring line 36 should be arranged within the ink volume so that heat may also be effectively transferred. The ink temperature in the distributor tank 16 thus always remains at approximately the nominal temperature, even during printing pauses, as long as ink heated to the nominal temperature circulates through the ring line 36.

In an exemplary embodiment, it is advantageous if the openings 41 of the supply line 38 are situated within the ink 19, so that fresh ink does not splash in the ink 19 and thereby create additional gas bubbles in said ink 19. Gas bubbles interfere with the generation of ink droplets (in particular the precise metering of the droplet sizes) in droplet generation in the print head 12.

In an exemplary embodiment, a fill level sensor 50 and/or a pressure sensor 52 are arranged at the distributor tank 16. With these, the fill level (or indirectly the negative pressure) of the ink 19 in the distributor tank 16 is measured. If the fill level is too low (equivalent to too high a negative pressure), the ink 19 does not flow well enough to the print heads 12. If the fill level is too high (equivalent to too low a negative pressure), ink leaks from the nozzles of the print heads 12 and may drip onto the recording medium 14 and/or contaminate the nozzle plates 51 (see FIG. 1) or even clog the nozzles, if ink dries there.

In print operation, in an exemplary embodiment, the fill level sensor 50 or the pressure sensor 52 serve to refill ink into the distributor tank 16 as needed in the event that the ink level threatens to become too low as a result of the ink consumption. The changeover switch 42, controlled by the fill level sensor 50 or the pressure sensor 5, then switches the inflow 32 to the supply line 38 until a desired fill level or negative pressure is achieved again. The changeover switch 42 subsequently switches the inflow 32 to the ring line 36 again so that the heated ink may circulate through the ring line 36 and the ink 19 in the distributor tank 16 may be tempered or be kept at temperature.

In an exemplary embodiment, a pressure sensor 52 is configured to measure the air pressure in the air volume 48 of the distributor tank 16, which is equivalent to the hydraulic negative pressure of the ink 19. The negative pressure is necessary for the print operation so that a good print quality is also achieved.

In an exemplary embodiment, a ventilation valve 56 is arranged at the distributor tank 16. The ventilation valve 56 is helpful given the initial process of filling the distributor tank 16 with ink. Upon filling the distributor tank 16, so much ink is filled into said distributor tank 16 that, initially, a desired fill level—and therefore a desired negative pressure—exists in the distributor tank 16. The negative pressure may not be too high and may not be too low, so that the ink droplets may be generated well and ejected in their desired size. Otherwise, no ink may exit the nozzles if this is not desired.

In an exemplary embodiment, the distributor tank 16 thus serves as a counter-pressure tank that ensures a slight negative pressure in the print head 12 so that the ink does not leak from the print head 12. A separate counter-pressure tank is then no longer required. It is advantageous if the distributor tank 16 is arranged very close to the print heads 12. The pressure drop up to the print head 12 is then very slight, and the negative pressure that is necessary for the best print quality may be precisely set.

In an exemplary embodiment, if the distributor tank 16 extends over all print heads 12 of a print bar 10 and is arranged optimally close to said print heads 12, all feed lines 18 to the print heads 12 are approximately equal in length (short), and largely identical conditions of the ink, such as temperature, hydraulic pressure, degree of degassing etc. prevail in all print heads 12. In an exemplary embodiment, the negative pressure and the ink temperature may be very precisely set identically for all print heads 12 since the temperature or the hydraulic pressure barely changes on the short feed lines 18.

In an exemplary embodiment, the ventilation valve 56 is used for the initial filling, or filling after emptying the distributor tank 16. Initially, the conveyor pump 24 is placed into operation so that hydraulic pressure is developed in the ink lines 20. The changeover switch 42 is switched so that the inflow 32 is in principle connected with the ring line 36, unless the control instruction is explicitly given to switch to the supply line 38 in order to refill fresh ink into the distributor tank 16. The ink thus circulates from the storage reservoir 22, via the degassing device 26, the particle filter 28, the heater 30, and via the ring line 36 and the outflow 34 back to the storage reservoir 22. The degassing device 26 does not necessarily need to be arranged in the intake for the distributor tank 16. The storage reservoir 22 may additionally or alternatively have a separate degassing device.

In an exemplary embodiment, the ventilation valve 56 is subsequently opened at the upper edge of the distributor tank 16 (the ventilation valve 56 is typically located at the highest point in the distributor tank 16). The changeover switch 42 now switches the inflow 32 to the supply line 38. The ink thus flows into the distributor tank 16. The air in the distributor tank 16 may escape via the ventilation valve 56. If a desired fill level of the ink 19 is achieved, the changeover switch 42 switches the inflow 32 back to the ring line 36. The ventilation valve 56 is closed. The hydraulic pressure in the ink 19 now corresponds to the normal pressure. The conveyor pump 24 is deactivated so that the ink lines 20 are without unpressurized, and the circulation of the ink through the ring line 36 is ended for the present time.

In an exemplary embodiment, the changeover switch 42 is configured to subsequently switch the inflow 32 to the supply line 38. Since the distributor tank 16 is located higher, in terms of its position, than the storage reservoir 22, and the conveyor pump 24 is deactivated, ink may now flow back into the storage reservoir 22 due to the height difference between distributor tank 16 and storage reservoir 22. Since the ventilation valve 56, and therefore the distributor tank 16, is closed in this state, a negative pressure thereby arises in the distributor tank 16, which negative pressure is measured continuously by means of pressure sensor 52 or fill level sensor 50. If a predetermined nominal value of the negative pressure is achieved, the changeover switch 42 switches the inflow 32 to the ring line 36 again, and the hydraulic pressure conditions no longer change unless ink is removed from or supplied to the distributor tank 16.

In an exemplary embodiment, the conveyor pump 24 is now activated again so that hydraulic pressure is developed and the ink 19 may circulate from the storage reservoir 22, via the degassing device 26, the particle filter 28 and the heater 30, through the ring line 36, back to the storage reservoir 22. The system is then ready for the print operation. Fresh ink that is degassed and is largely at nominal temperature is located in the distributor tank 16. The ink 19 in the distributor tank 16 is largely kept at the nominal temperature via the circulation of the heated ink through the ring line 36.

In an exemplary embodiment, after longer downtimes without printing, the temperature of the ink 19 in the distributor tank 16 slowly cools down. Therefore, just before the beginning of the print operation, the circulation of ink through the ring line 36 is activated so that the ink 19 in the distributor tank 16 may again be brought to approximately the nominal temperature. In the distributor tank 16, such a negative pressure prevails that optimally no ink 19 flows from the distributor tank 16 to the print heads 12 and may drip, leak, or seep there from the nozzles.

In the print operation, ink is continuously consumed, which ink engages in a replenishment flow from the distributor tank 16 to the print heads 12. The negative pressure in the distributor tank 16 increases due to the replenishment flow. However, the negative pressure may not rise too far, otherwise ink may no longer flow to the print heads 12. Therefore, ink must then be refilled into the distributor tank 16. Using the negative pressure, the pressure sensor 52 in the distributor tank 16 detects whether ink must be refilled into the distributor tank 16. As of a certain negative pressure, the changeover switch 42 is activated so that the inflow 32 is connected with the supply line 38. Fresh ink then arrives in the distributor tank 16 until the negative pressure has again dropped to a desired nominal value, and therefore a level has risen up to a desired fill level.

In the exemplary embodiment according to FIG. 1, only one conveyor pump 24 is arranged before the distributor tank 16, which conveyor pump 24 provides for the circulation of the ink. Of course, one or more additional conveyor pumps may also be arranged at the outflow 34, which additional conveyor pump draws ink from the ring line 36. The outflow 34 might also be arranged at a different side wall.

Additional ring lines 36 may also be present that are either fed from the same inflow 32 or have their own inflow. A separate conveyor pump and heater may also be arranged before an additional inflow in order to have ink circulate through the ring line 36 for the purpose of thermal transfer. Cooled ink 19 in the distributor tank 16 might thus be more quickly brought to the nominal temperature.

By contrast, if only a single conveyor pump 24 and a heater 30 are used, less structural space, energy, and material are required in the ink printing apparatus.

This device has the advantage that cooled ink 19 in the distributor tank 16 may be quickly brought to the nominal temperature again without additional heaters in the distributor tank 16 itself. The ink 19 in the distributor tank 16 may thus be tempered, meaning warmed or cooled, without using a separate heater or cooler. The danger is therefore reduced that the ink 19 in the distributor tank 16 may be much warmer or colder than the nominal temperature during the print operation.

If the distributor tank 16 is arranged optimally close to the print heads 12 and approximately parallel to this, and is longitudinally extended over all print heads 12, the feed lines 18 to the print heads 12 are thus all designed to be of equal length and optimally short. This has the advantage that a temperature drop or gas bubbles, which would negatively affect the generation of ink droplets, and therefore the print quality, may hardly arise.

The distributor tank 16 may be round (as shown in FIGS. 3*a* and 3*b*), rectangular, or be designed with any other suitable cross sectional shape. It has a longitudinal axis that travels approximately parallel to the plane in which the print heads 12 are situated, meaning parallel to the surface of the nozzle plates 51 of the print heads 12. The distributor tank 16 extends in a longitudinally extended manner across at least all ink outlets 44 via which ink is directed via the feed lines 18 to the print heads 12, and therefore across all print heads 12.

The print heads 12 may have one or more feed lines 18 via which ink is directed to the print heads 12. If a plurality of feed lines 18 to one print head 12 is present, one of the feed lines 18 may be used to ventilate the print head 12 if ink arrives in said print head 12 via a different feed line 18. The ink supplied via the first feed line 18 displaces air from the print head 12, which air may escape via the second feed line 18 into the distributor tank 16. However, little air is thereby involved, which only slightly increases the air volume 48.

In an exemplary embodiment, one or more of the lines may be tubes or hoses that are manufactured from metal or plastic. The ring line 36 is a through-flow line via which ink flows from the inflow 32 to the outflow 34. The ring line 36 has no openings or outlets in the distributor tank 16. The wall of the ring line 36 should be optimally rigid (or be held by supports) and as thermally conductive as possible, so that a thermal transfer may occur between the ink 19 in the distributor tank 16 and the ink flowing in the ring line 36.

The thermal conductivity may be accomplished via a correspondingly used material of the wall of the ring line 36, and/or a sufficiently thin (but nevertheless rigid) material may be used via which a rapid thermal transfer is possible. The material of the ring line 36 must be so rigid that, in operation, the ring line 36 largely maintains its position in the middle of the ink 19, extending across the region of the print heads 12. For example, a thin-walled copper tube is very advantageous as a ring line 36. The ring line 36 may also be held in its position by supports (not shown).

A plurality of ring lines 36 may also be present, and with their own infrastructure such as conveyor pumps, heating, and if applicable particle filters and degassing device. It is advantageous to feed multiple ring lines 36 with the same infrastructure. The ink 19 in the distributor tank 16 may thereby be more quickly and effectively tempered, and only a single conveyor pump 24 and heater 30 are required.

It is advantageous if the ring line 36 has an optimally large surface relative to the ink 19 in the distributor tank 16, and a good thermal conductivity so that a more efficient thermal transfer occurs. The distributor tank 16 should thus have a relatively large length (such as a relatively long loop) and/or large shell surface (with a relatively large periphery) and/or a thin wall, in order to effectively and quickly temper the ink 19 in the distributor tank 16 with the aid of the ink that is heated to the nominal temperature and flows through said ring line 36. In addition to this, the ring line 36 should largely extend across the region of the print heads 12 (meaning in the region of the ink outlets 44 for the feed lines 18 to the print heads 12). A uniform temperature distribution of the ink in the region of the ink outlets 44 is then achieved.

In an exemplary embodiment, the supply line 38 may be rod-shaped in design and has at least one opening 41 within the distributor tank 16, from which ink flows into the distributor tank 16. It is advantageous if a plurality of openings from which ink may flow is arranged along the length of the supply line 38. It is advantageous if, for example, the openings 41 are arranged uniformly over the entire length of the supply line 38. It is thereby achieved that the fresh ink may distribute or mix well and uniformly in the distributor tank 16. It is also advantageous if the end with its opening 41 located in the distributor tank 16 is curved so that the outflowing ink provides for a swirling and mixing of the ink 19 in the distributor tank 16.

In an exemplary embodiment, the openings 41 may also have different diameters or nozzle shapes from which the ink flows with different strengths and/or in desired directions (see FIG. 3*a* or 3*b*; see flow arrows at the supply line 38). The mixing of the fresh ink with the ink 19 in the distributor tank 16 is thereby improved. The degree of degassing thereby remains high, and the temperature distribution is homogenized. Ink is therewith provided to all print heads 12 under largely identical conditions. It is also advantageous if fresh ink flows from the openings 41 in the regions of the ink outlets 44 so that optimally well-conditioned ink may also be supplied to the print heads 12.

In an exemplary embodiment, the feed lines 18 may be designed as hoses or tubes. Here, a thermally insulating material should optimally be used so that the temperature of the ink does not drop or cool off too severely on the way to the print heads 12. It is advantageous if the feed lines 18 to the print heads 12 are all of an identical length and are designed to be as short as possible. Then, largely the same conditions prevail in all print heads 12, with an ink near the nominal temperature, so that largely uniform inking (optical density) is possible over the line width.

In an exemplary embodiment, the heater 30 before the distributor tank 16 is a heat exchanger that heats the ink coming from the storage reservoir 22 to a desired nominal temperature. The print quality is best if ink that has a predetermined temperature (here approximately the nominal temperature) is provided to the print heads 12. The heater 30 may be a plate heat exchanger, a tubular heater, or also any other suitable fluid heater/heat exchanger. It is advantageous if the heater 30 is arranged near the distributor tank 16, so that a temperature drop barely occurs on the way to the distributor tank 16, and ink that is heated to the nominal temperature is supplied to the distributor tank 16. Since the ink flows continuously through the heater 30 and is thereby heated to the nominal temperature, the heater 30 does not need to be deactivated and may be operated in a low-energy manner.

In an exemplary embodiment, the changeover switch 42 is a fluid switch configured to switch fluids from one fluid branch to another fluid branch. Here, the heated and degassed ink coming from the storage reservoir 22 is switched to the ring line 36 or the supply line 38. A multi-way valve (for example a 3/2-way valve) may advantageously be used for this purpose. Functionally equivalent fluid switches may also be used that switch the fluid path back and forth between the supply line 38 and the ring line 36.

As a result of the printing (ejection of ink droplets), ink 19 is automatically supplied as needed from the distributor tank 16 to the print heads 12 as long as the negative pressure in the distributor tank 16 is within a tolerable range. Via actuators of the print head 12, an overpressure is generated via expansion, whereby ink droplets are ejected from associated nozzles. Fresh ink flows into the print head 12 to replenish the ink consumed in such a manner. As a result of the replenishment of ink into the print heads 12, the hydraulic pressure conditions in the distributor tank 16 change.

Depending on the utilization of the nozzles, i.e. depending on the print image, more or fewer droplets are simultaneously ejected by the plurality of nozzles. The print utilization may change precipitously, for example if stripe patterns or page transitions (beginning or end of a newly printed page) are printed. Many nozzles or barely any nozzles are then cyclically active in alternation. The ink consumption (print utilization) of the print head 12 thereby changes suddenly. This leads to strong hydraulic pressure fluctuations and hydraulic oscillations in the ink supply (meaning in the distributor tank 16, in the feed lines 18, and in the print head 12). Oscillations that are too strong may lead to the situation that the pressure generation, and therefore the generation of ink droplets, is negatively affected. Such hydraulic oscillations may be damped by air dampers in order to reduce their negative effects on the droplet generation, and therefore on the image quality.

Therefore, it is advantageous if an air volume 48 is present in the distributor tank 16, via which air volume 48 the hydraulic oscillations may be damped. Oscillations and pressure fluctuations in the distributor tank 16 as a result of ink suddenly flowing in via the supply line 38 may also be damped with the air volume 48.

In the distributor tank 16, the negative pressure prevailing there is measured in order to be able to decide, during print operation, whether fresh ink should be supplied because too high a negative pressure prevails in the distributor tank 16. Therefore, the device has the pressure sensor 52, which measures either the air pressure (here negative pressure) or the fluid pressure in the ink 19. With corresponding activation electronics 46, the measured real values may be evaluated and corresponding measures (such as the activation of the changeover switch 42) introduced if the negative pressure decreases or increases.

In an exemplary embodiment, instead of a pressure sensor 52, a fill level sensor 40 may also be used that detects the ink level (fill level of the ink 19) in the distributor tank 16. If the ink level decreases too starkly, then the negative pressure is too great, such that the ink supply of the print heads 12 is endangered (the too-great hydrostatic negative pressure counteracts the ink flow to the print heads 12). Fresh ink must then be refilled from the storage reservoir 22 into the distributor tank 16 so that the negative pressure becomes smaller again (i.e. so that the hydraulic pressure and also the ink level increase).

In an exemplary embodiment, a print bar 10 has at least one print head 12 with which ink droplets are applied onto the recording medium 14 line by line (transversal to the transport direction of the recording medium 14). If the print width is too large for a single print head 12, multiple print heads are arranged in at least two rows, wherein the nozzles overlap slightly in the edge regions of the print heads 12 so that all print positions may be addressed and printed to given corresponding print resolution of a line. In FIG. 2, the feed lines 18 to the forward row of print heads 12 are depicted as solid lines, and the feed lines 18 to the rear row are depicted with dashed lines (in this exemplary embodiment, two respective feed lines 18 per print head 12).

In an exemplary embodiment, the distributor tank 16 extends approximately parallel to a plane in which the print heads 12 (nozzle plates 51) are arranged. The distributor tank 16 is arranged optimally close to the print heads 12. The distributor tank 16 must have a sufficiently large internal volume in which the ring line 36, the supply line 38, a sufficiently large ink volume, and a sufficiently large air volume 48 are present. It is also advantageous if the outer shell of the distributor tank 16 is manufactured from a poorly thermally conductive material, or is thermally insulated. Little heat is thus lost to the outside, whereby the ink 19 in the distributor tank 16 remains approximately at the nominal temperature for longer.

In an exemplary embodiment, the circulation of the ink in the ring line 36 takes place continuously as soon as the changeover switch 42 has switched to the ring line 36 and the conveyor pump 24 is activated. The velocity of the ink flow depends on, among other things, the heat requirement of the ink 19 in the distributor tank 16, or also on the thermal transfer efficiency of the ring line 36.

In an exemplary embodiment, the conveyor pump 24 may also be operated in a timed manner. As soon as the temperature of the ink 19 in the distributor tank 16 threatens to fall below a threshold or becomes too warm, the conveyor pump 24 must be activated in order to temper the ink 19 in the distributor tank 16. It is advantageous to provide a temperature sensor 54 in the distributor tank 16 and/or after the outflow 34 in the ink line 20, via which temperature sensor 54 the circulation of the ink may be controlled. The flow velocity upon circulation might thus also be controlled.

Given a greater heat requirement (large difference between the real temperature and the nominal temperature), the ink might flow faster, and given a smaller heat requirement the ink might flow slower.

The sealing element 40 seals the distributor tank 16 from the outside and has fluid channels through which ink may flow. The changeover switch 42, which directs the ink from the inflow 32 to a first branch of the ring line 36 or to the input of the supply line 38, is arranged in the sealing element 40. A line that connects a second branch of the ring line 36 with the outflow 34 passes through the sealing element 40.

A color ink printing apparatus has a separate device with distributor tank 16 and print bar 10 for each color used for the printing (typically the primary colors YMCK or RGB, or customer-specific colors), which distributor tank 16 and print bar 10 are filled with ink of the corresponding color. The individual colored inks are respectively supplied from an ink bottle to the storage reservoir 22. From there, the distributor tank 16 and the print heads 12 are then supplied with ink as described above.

A recording medium 14 that is moved along below the print bar 10, relative to the print heads 12, is printed to with the ink. The print bars 10 are arranged parallel to one another and transversal to the transport direction of the recording medium 14. At least one print bar 10 is present for each color to be printed. Special inks or fluids, such as MICR ink or primer, may additionally also be printed with the print bars 10.

In an exemplary embodiment, the printed recording medium 14 is subsequently supplied to a drying or fixing device so that the print image permanently adheres to the recording medium and may subsequently be further processed as needed in order to create a finished print product, for example a book. The design of such an ink printing apparatus in principle (in particular there with a recording medium 14 in the form of a web) is presented in the patent document U.S. Pat. No. 9,248,667 B1, whose disclosure is herewith explicitly incorporated into the present specification.

A workflow diagram of a method for supplying a print head with ink in an ink printing apparatus is presented in FIG. 4. The ink 19 in the distributor tank 16 is thereby regulated (step S1) such that sufficient ink 19 with a corresponding negative pressure (ink level) is always present in the distributor tank 16, and this ink 19 also largely always has the nominal temperature.

Upon regulation, in a second step S2 the hydraulic pressure (negative pressure) or the fill level (and the negative pressure determined therefrom) of the ink in the distributor tank 16 is measured. The measured value is compared with a lower threshold value (lower threshold or lower fill level) (step S3). If the negative pressure is too great (threshold is reached or fallen below), the hydraulic pressure falls below the lower threshold. In order to have the hydraulic pressure rise again, ink must be replenished into the distributor tank 16.

In this instance, the changeover switch 42 is then controlled such that it switches the ink flow from the ring line 36 to the supply line 38 (step S4). As a result of this, ink is replenished into the distributor tank 16, whereby the ink level rises. At the same time, the negative pressure drops (hydraulic pressure rises).

The ink level/negative pressure in the distributor tank 16 is thereby continuously monitored/measured (step S5). When so much ink has been filled in that the measurement value reaches or exceeds an upper threshold value (upper threshold or upper fill level) (step S6), the changeover switch 42 switches the ink flow back from the supply line 38 to the ring line 36 (step S7) so that ink no longer flows into the distributor tank 16. Instead of this, heated ink flows through the ring line 36 in order to temper the ink in the distributor tank 16 and to largely keep it at the nominal temperature.

It is thus ensured that there is always sufficient ink 19 in the distributor tank 16, whereby a correspondingly sufficient negative pressure is set so that ink may be supplied well and sufficiently to the print heads 12. In addition to this, it is ensured that the ink 19 in the distributor tank 16 always largely has the nominal temperature in a print operation.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 print bar
12 print head
14 recording medium
16 distributor tank
18 feed line
19 ink in distributor tank
20 ink line
22 storage reservoir
24 conveyor pump
26 degassing device
28 particle filter
30 heater
32 inflow
34 outflow
36 ring line
36', 36" line branch of the ring line
38 supply line
40 sealing element
41 opening of the supply line
42 changeover switch
44 ink outlet
46 activation electronics
48 air volume
50 fill level sensor
51 nozzle plate of a print head
52 pressure sensor
54 temperature sensor
56 ventilation valve

The invention claimed is:

1. A device for supplying ink to at least one print head of a print bar of an ink printing apparatus, comprising:

a distributor tank connected to the at least one print head and configured to supply the at least one print head with the ink, the distributor tank being connected via at least one heater with a storage reservoir, wherein fresh ink is drawn from the storage reservoir and heated by the heater to a nominal temperature, the heated ink being supplied to the distributor tank;

at least one ring line and a supply line that are arranged in the distributor tank; and a changeover switch arranged between the at least one ring line and the supply line, and configured to switch the ink conveyed from the storage reservoir to one of the at least one ring line and the supply line based on a predetermined fill level of the ink in the distributor tank, wherein:

the heated ink flows through the at least one ring line without ink being directed into the distributor tank, and the supply line includes at least one opening via which ink is filled into the distributor tank.

2. The device according to claim 1, wherein the distributor tank extends across all print heads of the at least one print head that print with a same color, and the distributor tank includes at least one corresponding ink outlet for each of the at least one print head that is connected via a feed line to the at least one print head to direct ink from the distributor tank to the at least one print head.

3. The device according to claim 1, wherein the heater is a heat exchanger via which through-flowing ink is heated to a nominal temperature, the heater being arranged near to and before the distributor tank, whereby the ink coming from the storage reservoir and flowing through the heater is heated.

4. The device according to claim 1, wherein the distributor tank is filled with at least a quantity of the ink such that: at least a majority of each of the at least one ring line and the supply line are surrounded with ink, and an air volume remains above the ink in the distributor tank.

5. The device according to claim 4, further comprising a sensor arranged in the distributor tank, and configured to:

determine the hydraulic pressure in the distributor tank to regulate the quantity of ink in the distributor tank, wherein fresh ink is filled into the distributor tank in response to the determined hydraulic pressure is below a predetermined threshold value.

6. The device according to claim 1, wherein the ring line is produced from a thermally conductive material and to have an increased surface area in the distributor tank to temper the ink in the distributor tank based on the ink flowing through the at least one ring line having been heated to the nominal temperature.

7. The device according to claim 1, wherein the supply line comprises multiple openings arranged and distributed along a length of the supply line, the supplied ink flowing into the distributor tank via the multiple openings.

8. An ink printing apparatus comprising:

a respective device according to claim 1 for each color used for printing by the ink printing apparatus, wherein ink is supplied from an ink bottle to each of the respective storage reservoirs; and a dryer or fixer that is configured to dry or fix a recording medium having been printed to, wherein the recording medium moves relative to and below the at least one print head.

9. A method for supplying at least one print head with ink in an ink printing apparatus, the at least one print head being supplied with ink via an associated distributor tank, wherein a ring line is arranged in the distributor tank through which heated ink flows without arriving in the distributor tank, and a supply line is arranged in the distributor thank and that has at least one opening to fill ink into the distributor tank, the method comprising:

measuring a measurement value corresponding to a hydraulic pressure of the ink in the distributor tank;

controlling a changeover switch to switch an ink flow from the ring line to the supply line in response to the measurement value falling below a predetermined first threshold value so that ink is replenished in the distributor tank; and controlling the changeover switch to switch the ink flow from the supply line to the ring line in response to the measurement value exceeding a second threshold value so that the heated ink flows through the ring line to temper the ink in the distributor tank.

10. A non-transitory computer-readable storage medium with an executable program stored thereon, that when executed, instructs a processor to perform the method of claim 9.

* * * * *